US009494902B2

(12) United States Patent
Takai et al.

(10) Patent No.: US 9,494,902 B2
(45) Date of Patent: Nov. 15, 2016

(54) FIXING BELT, FIXING DEVICE, AND IMAGE FORMING APPARATUS

(71) Applicants: Atsushi Takai, Kanagawa (JP); Satoshi Tohkai, Kanagawa (JP); Norihiko Aze, Kanagawa (JP)

(72) Inventors: Atsushi Takai, Kanagawa (JP); Satoshi Tohkai, Kanagawa (JP); Norihiko Aze, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/956,016

(22) Filed: Dec. 1, 2015

(65) Prior Publication Data

US 2016/0154351 A1 Jun. 2, 2016

(30) Foreign Application Priority Data

Dec. 2, 2014 (JP) ..... 2014-243776

(51) Int. Cl.
*G03G 15/20* (2006.01)

(52) U.S. Cl.
CPC ..... *G03G 15/2057* (2013.01)

(58) Field of Classification Search
CPC ..... G03G 15/2053; G03G 15/2017; G03G 15/2057; G03G 2215/2016
See application file for complete search history.

(56) References Cited

U.S. PATENT DOCUMENTS

2003/0127173 A1 7/2003 Kamiya et al.
2003/0235417 A1 12/2003 Aze et al.
2004/0129062 A1 7/2004 Aze et al.
2004/0224165 A1 11/2004 Kondoh et al.
2005/0123673 A1 6/2005 Kamiya et al.
2005/0286938 A1 12/2005 Aze et al.
2006/0056890 A1 3/2006 Aze et al.
2006/0120778 A1 6/2006 Aze et al.
2006/0289420 A1 12/2006 Hasegawa et al.
2007/0140758 A1 6/2007 Aze et al.
2008/0003030 A1 1/2008 Aze et al.
2008/0063444 A1 3/2008 Kondoh et al.

FOREIGN PATENT DOCUMENTS

JP 2005-189404 7/2005
JP 2006-343538 12/2006
JP 2006343538 A * 12/2006
JP 2014-048658 3/2014

* cited by examiner

*Primary Examiner* — Walter L Lindsay, Jr.
*Assistant Examiner* — Jessica L Eley
(74) *Attorney, Agent, or Firm* — Duft Bornsen & Fettig LLP

(57) ABSTRACT

A fixing belt for a fixing device of an image forming apparatus includes a base layer including a heat-resistant resin and a mesh member embedded in the heat-resistant resin and including a metal member, in which the mesh member includes an opening. The heat-resistant resin fills in the opening. A thickness of the thinnest portion of the mesh member is 40% or more of the thickness of the base layer. A fixing device includes a heating member; a pressure member; and the fixing belt as described above. Further, an image forming apparatus includes an image forming section and the fixing device including the above described fixing belt.

8 Claims, 5 Drawing Sheets

FIXING BELT, FIXING DEVICE, AND IMAGE FORMING APPARATUS

CROSS-REFERENCE TO RELATED APPLICATION

The present application claims priority pursuant to 35 U.S.C. §119(a) from Japanese patent application number 2014-243776, filed on Dec. 2, 2014, the entire disclosure of which is incorporated by reference herein.

BACKGROUND

Technical Field

The present invention relates to a fixing belt, a fixing device, and an image forming apparatus.

Background Art

As a fixing device employed in an image forming apparatus, an endless fixing belt is used to fix an unfixed toner image onto a recording medium.

With such a fixing belt, a metallic heat generation layer is formed between a base layer and an elastic layer, and a heat generation layer is heated by electromagnetic induction. In the above fixing belt, the base layer is formed of a resin, and the heat generation layer is a mesh, so that flexibility as a whole is improved.

SUMMARY

In one embodiment of the disclosure, provided is an improved fixing belt for a fixing device of an image forming apparatus that includes a base layer including a heat-resistant resin and a mesh member embedded in the heat-resistant resin and including a metal member, in which the mesh member includes an opening. The heat-resistant resin fills in the opening. A thickness of the thinnest portion of the mesh member is 40% or more of the thickness of the base layer.

Other embodiments of the disclosure provide a fixing device including a heater to heat the fixing belt; a pressure rotator disposed opposing the fixing belt; and the fixing belt as described above, as well as an image forming apparatus including an image forming section to form an image on a recording medium; and the above fixing device to fix the image on the recording medium.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will now be described with reference to accompanying drawings. In the following description, a part or component having a same or similar structure is given the same reference number in each embodiment and a duplicated explanation thereof will be omitted.

First Embodiment

Figure 1:
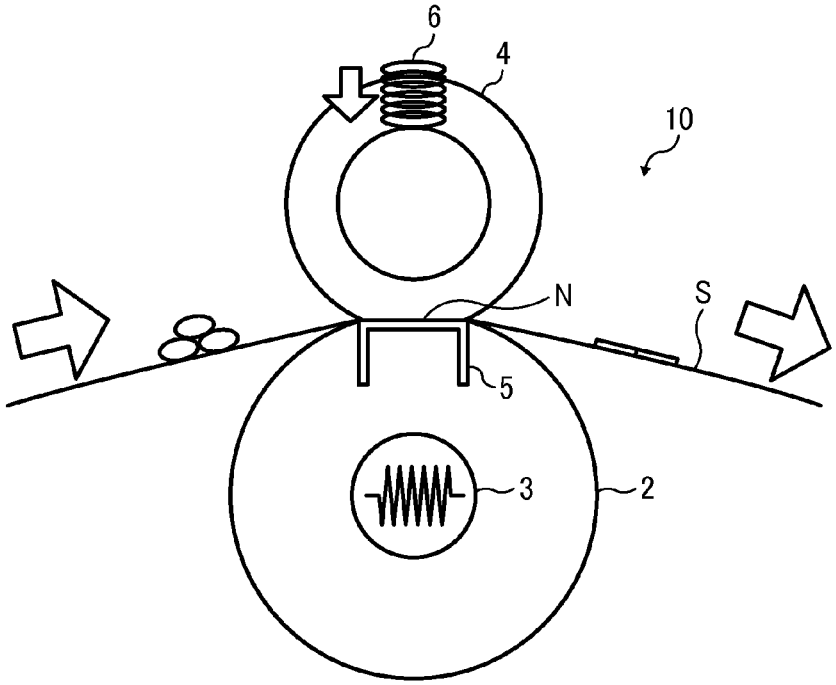
FIG. 1 schematically illustrates a fixing device according to a first embodiment of the present invention.
Figure 2:
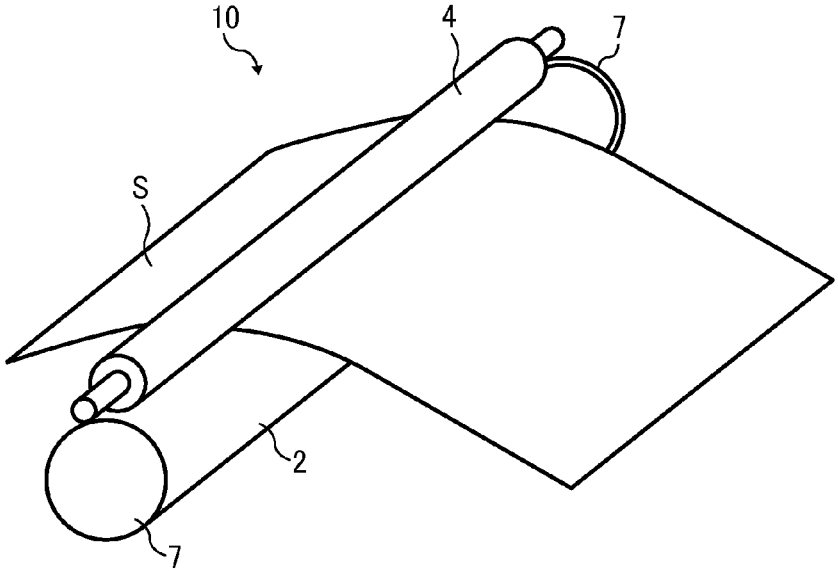
FIG. 2 is an oblique view of the fixing device according to the first embodiment of the present invention.

FIG. 1 schematically illustrates a fixing device 10 according to a first embodiment of the present invention, and FIG. 2 is an oblique view of the fixing device 10.

The fixing device 10 includes an endless fixing belt 2 formed into a cylindrical loop shape, a heater 3 disposed within the loop formed by the fixing belt 2, a pressure roller 4 serving as a pressure rotator, a pressure pad 5, a pressure member 6, and a flange 7. The fixing device 10 includes a nip portion N formed between the fixing belt 2 and the pressure roller 4. When a recording sheet S on which unfixed toner is carried passes through between the nip portion N, the toner on the recording sheet S is fixed thereon.

The fixing belt 2 is endless and has lateral edges rotatably supported by the flange 7, and thereby rotates driven by the pressure roller 4. Details of the fixing device 10 will be described later below.

The heater 3 is, for example, a heat source such as a halogen heater, and is disposed in an interior of the fixing belt 2 so as to heat the fixing belt 2 from an inner side. In addition, the heater 3 may be configured of a ceramic heater or a carbon heater.

The pressure roller 4 includes a metallic roller base and a silicone rubber layer serving as an elastic layer formed on the outer periphery of the metallic roller. The pressure roller 4 further includes a perfluoroalkoxy fluorine resin (PFA) layer or polytetrafluoroethylene (PTFE) layer, disposed on the silicon rubber layer, to obtain good releasability of the recording sheet. The pressure roller 4 rotates driven by a motor, a drive source, via transmission gears.

The pressure roller 4 is pressed against the fixing belt 2 via the pressure member 6, such as a spring, in a direction indicated by an arrow in FIG. 1. The elastic layer of the pressure roller 4 is squeezed and is deformed, so that the nip portion N conforming to a shape of the pressure pad 5 is formed between the fixing belt 2 and the pressure roller 4.

The pressure roller 4 may be a solid-core roller, but preferably is a hollow roller due to the smaller thermal capacity thus required. Further, a heat source such as a halogen heater may be disposed to the pressure roller 4.

The pressure pad 5 includes a surface that slides with the fixing belt 2, and the sliding surface is coated with diamond-like carbon, PTFE, molybdenum disulfide, graphite, and the like, so that the friction coefficient thereof is lowered. A lubricant such as a silicon grease or fluorine grease is preferably coated on the coated sliding surface, so that rotation of the fixing belt may be stabilized due to such a lubricant.

Around the heater 3, a reflection member directed to the nip portion N upstream may be disposed, and/or the fixing belt 2 can be locally heated near the nip portion N.

When the recording sheet S passes through the nip portion N formed between the pressure roller 4 and the fixing belt 2 heated by the heater 3, the unfixed toner is fused and is fixed onto the recording sheet S.

Figure 3:
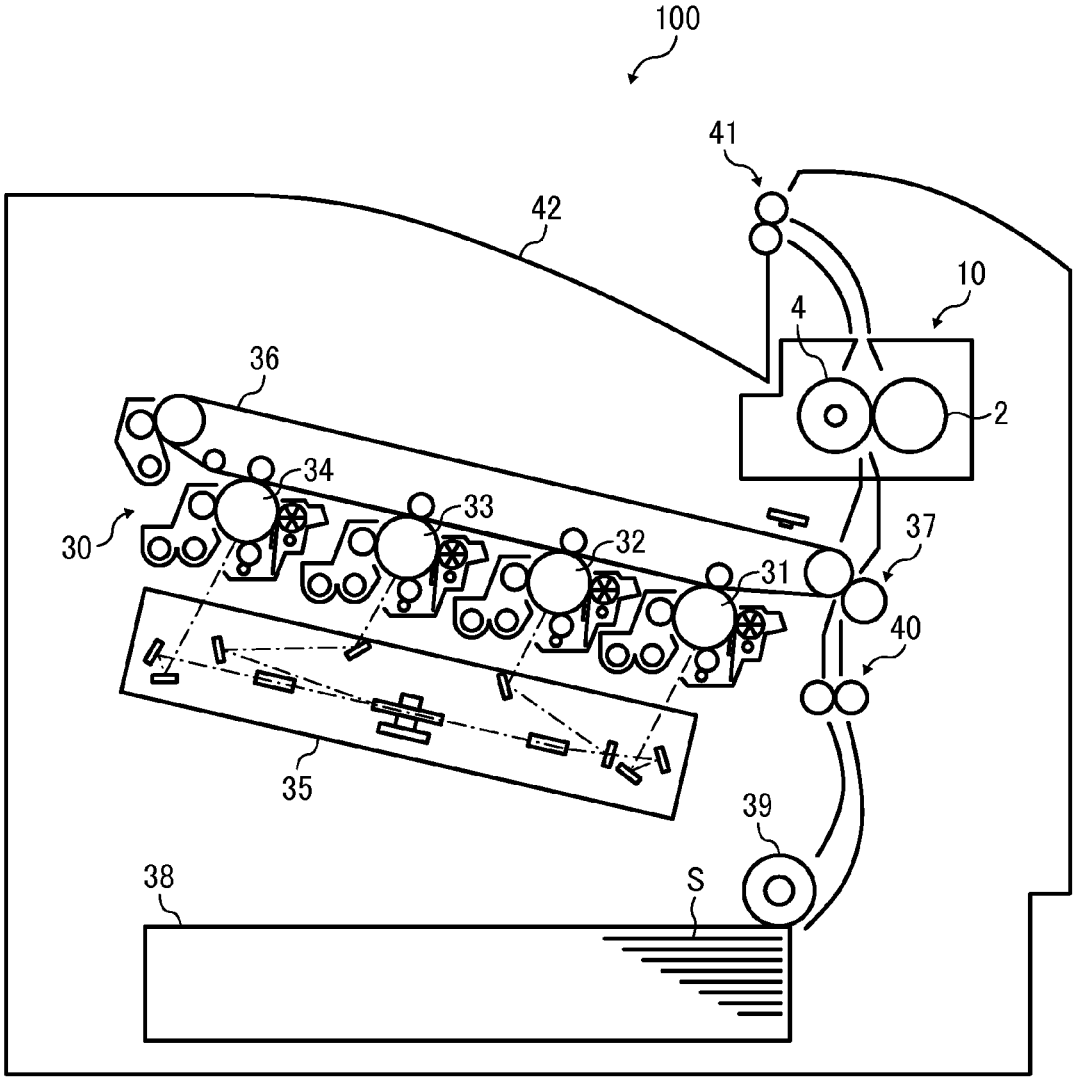
FIG. 3 is a schematic cross-sectional view of an image forming apparatus including the fixing device according to the first embodiment of the present invention.

Next, a structure of the image forming apparatus 100 employing the above-described structure will be described referring to FIG. 3.

The image forming apparatus 100 is a tandem-type color printer in which a plurality of image forming units each forming a different color image is juxtaposed along a stretching direction of the belt. However, the present invention is not limited to this structure, and without limiting to the printer, the present invention may be employed in a copier and a facsimile machine.

The image forming apparatus 100 includes a fixing device 10, and an image forming section 30 employing electrophotographic method. The image forming section 30 includes a photoconductor drum 31 for black color, a photoconductor drum 32 for magenta color, a photoconductor drum 33 for cyan color, and a photoconductor drum 34 for yellow color. Each photoconductor drum 31 to 34 includes a corresponding toner developing device and a transfer device.

The image forming apparatus 100 further includes an optical unit 35 that exposes each of the photoconductor drums 31 to 34 corresponding to each color based on image data input from an external apparatus to thus form a latent image of each color, and each latent image is rendered visible by each toner developing device. Further, the thus-rendered visible toner image is transferred onto an intermediate transfer belt 36, to render it as a color toner image, which is further transferred by a transfer device 37 to the recording sheet S that is conveyed thereto.

The recording sheet S is fed from a sheet cassette 38 by a sheet feed roller 39, and a color toner image is transferred by the transfer device 37 onto the recording sheet S that is conveyed at a matched timing adjusted by a pair of registration rollers 40, and the recording sheet S is then conveyed to the fixing device 10. The recording sheet S after transfer is heated and pressed by the fixing device 10, and the toner image thereon is melted and fixed. The recording sheet S after fixation is then discharged outside the apparatus 100 by a pair of sheet discharge rollers 41, and is stacked on a sheet discharge tray 42 disposed outside the apparatus 100.

Next, details of the fixing device 2 will be described.

Figure 4:
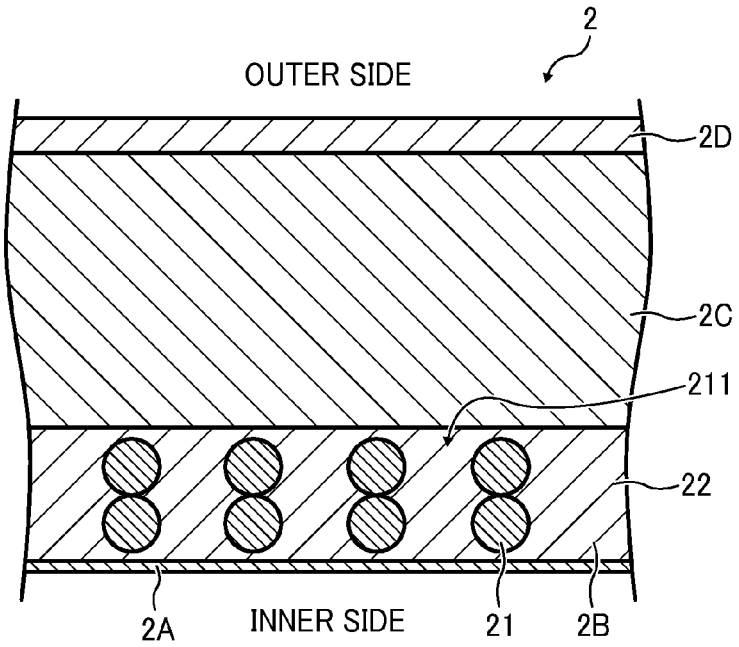
FIG. 4 is a cross-sectional view illustrating a fixing belt of the fixing device.

FIG. 4 is a cross-sectional view of the fixing belt 2 according to the present embodiment and illustrates that the fixing belt 2 includes, from an inner side to an outer side, a friction layer 2A, a base layer 2B, an elastic layer 2C, and a release layer 2D, in this order.

The friction layer 2A is formed of polytetrafluoroethylene (PTFE) in which carbon black is dispersed. As a result, friction between the pressure pad 5 and the flange 7 is reduced and thermal radiation from the heater 3 can be absorbed easily. A thickness of the friction layer 2A is, for example, set to 15 μm.

The base layer 2B includes a mesh member 21 and a heat-resistant resin 22, and specifically, the mesh member 21 is embedded in the heat-resistant resin 22. In the present embodiment, inner and outer surfaces of the mesh member 21 are covered by the heat-resistant resin 22; however, one surface of the mesh member 21 need only be covered by the heat-resistant resin 22, and the other surface can be exposed. Further, the mesh member 21 includes an opening 211, which is also filled with the heat-resistant resin 22. A total thickness of the base layer 2B is, for example, set to 60 μm.

Figure 5:
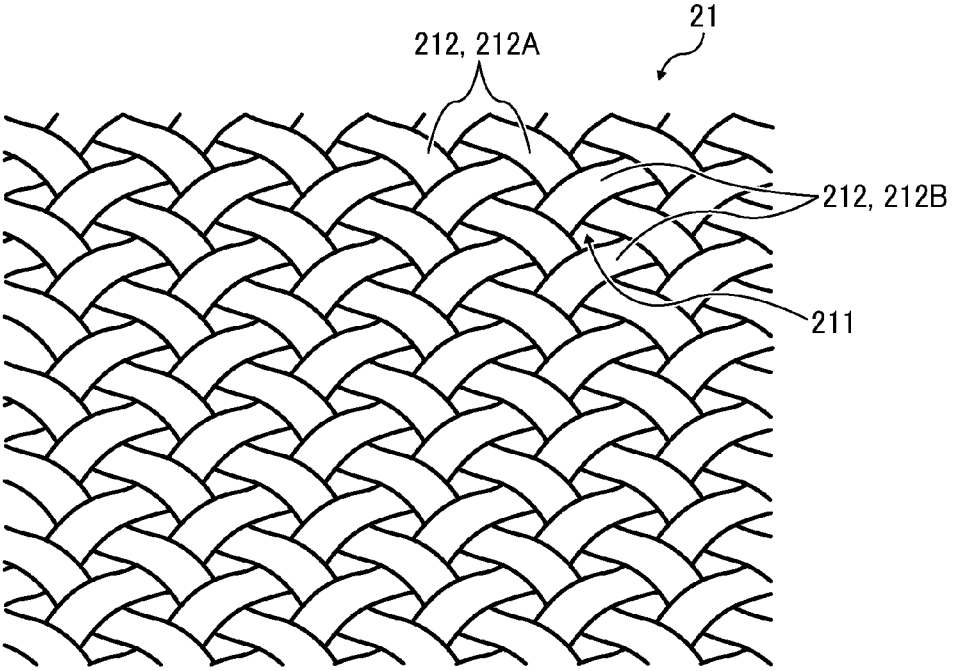
FIG. 5 is an oblique view illustrating a mesh member disposed in a base layer of the fixing belt.

As illustrated in FIG. 5, the mesh member 21 includes a netlike structure due to the presence of a plurality of fibriform members 212. Specifically, the mesh member 21 includes a plurality of fibriform members 212A extending in a predetermined direction and another plurality of fibriform members 212B extending in a direction substantially perpendicular to the direction of the plurality of fibriform members 212A, in which the fibriform members 212A and 212B are woven, so that a plurality of openings 211 each having a square shape is formed.

It is noted that the crossing angle of the fibriform members 212A and the fibriform members 212B is arbitrary, and a distance between adjacent fibriform members 212 need not be constant. Specifically, the opening 211 may be any parallelogram shape, including a rectangle or a diamond shape.

The fibriform member 212 is formed of at least a metal selected from a group of metals including stainless steel, aluminum, copper, cobalt, gold, and silver, to have a cross-sectional shape of a circle; however, its cross-sectional shape is arbitrary. In addition, the fibriform member 212 includes a core, formed of a heat-resistant resin, coated with a metallic material thereon.

It is preferred that the metallic material be highly thermally conductive, so that any metal other than the above exemplary metals may be used. Alternatively, any alloy formed of the above exemplary metals and other metals in combination may be used.

An outer diameter of the fibriform member 212 is, for example, set to 25 μm, which means that the least thickness of the mesh member 21 is set to 25 μm. If the fibriform member 212 includes coating by the metallic member as described above, the outer diameter includes a thickness of the metallic member. In addition, when the cross-sectional shape of the fibriform member 212 is formed to have a shape other than the circle, the outer diameter is defined as a size in the depth direction of the fixing belt 2.

Figure 6:
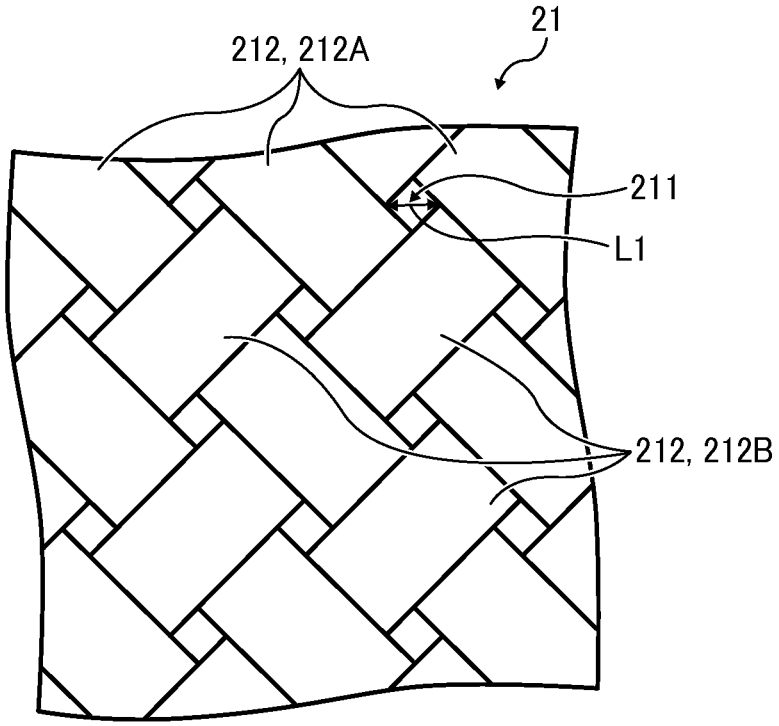
FIG. 6 is a front view illustrating the mesh member of the fixing belt.

As illustrated in FIG. 6, the diameter of the opening 211 of the mesh member 21, that is, a length L1 of a diagonal line of the opening 211 is, for example, set to 36.5 μm. When the opening 211 has a parallelogram shape other than a square, the diameter is defined to be a length of the longer diagonal line.

The heat-resistant resin 22 is formed of at least one of a group including polyimide, polyamideimide, polyphenilen sulfide, polyetheretherketone, polyether sulphone, polysulfone, and liquid crystal polymer.

The heat-resistant resin 22 preferably includes a sufficient mechanical strength and heat resistance, and can be formed of resins other than the above examples. Alternatively, any resin in which the above resins and other types of resins are arbitrarily combined can be used.

In the present embodiment, the mesh member occupancy, that is, the outer diameter of the fibriform members 212 divided by the thickness of the base layer 2B, is set to 41.7%. The mesh member 21 has a largest thickness at a position where two fibriform members 212A, 212B overlap, and a ratio of the thickness relative to the whole thickness of the base layer 2B, that is, the occupancy of the largest thickness portion, is 83.3%.

The largest thickness portion occupancy is preferably below 90%, and more preferably below 95%. If the largest thickness portion occupancy exceeds 95%, a thickness of the heat-resistant resin 22 overlapping with the mesh member 21 becomes too thin, so that a flexibility of the base layer 2B is reduced, and the mesh member 21 may break the overlapping portion when the base layer 2B is bent.

The elastic layer 2C includes an elastic member such as silicone rubber, and the thickness thereof is set to, for example, 250 μm. The fixing belt includes an uneven surface with minute concavities and convexities. Because the fixing belt includes the elastic layer 2C, the minute concavities and convexities on the surface of the fixing belt is absorbed in crushing and fixing an unfixed image, thereby preventing this concavity and convexity from transferring to the recording sheet S.

The release layer 2D is formed of a fluorine resin layer such as a PFA resin layer and PTFE resin layer, so that the toner does not adhere to the release layer 2D. A thickness of the release layer is, for example, set to 30 μm.

The following optimal results can be obtained by the present embodiment.

Specifically, because the base layer 2B of the fixing belt 2 includes the metallic mesh member 21, the mesh member 21 can be heated up easily by the heater 3 compared to a structure in which such a mesh member is disposed separately from the base layer. Accordingly, the thus-formed fixing belt 2 is disposed in the fixing device 10, and the image forming apparatus 100 including the fixing device 10 as configured above can shorten the time required for activation and can reduce power consumption.

Further, the mesh member 21 shows high flexibility, improves flexibility of the base layer 2B, and improves durability of the fixing belt 2 as a whole. In this case, the outer diameter of the fibriform member 212 is set to 25 μm and the thickness of the base layer 2B is set to 60 μm. That is, the outer diameter of the fibriform member 212 takes 41.7% of the whole thickness of the base layer 2B. Due to the occupancy of 40% or greater, easier heat-up and high flexibility of the fixing belt 2 are achieved collaterally.

Further, because the mesh member 21 includes an opening 211 filled with the heat-resistant resin 22, the surface of the base layer 2B can be smoothed, thereby preventing an uneven image from occurring in the fixed image. Further, adherence property between the mesh member 21 and the heat-resistant resin 22 and its integrity is improved, compared to a structure in which a mesh member is overlapped on top of the heat-resistant resin layer. Further, a member to adhere both layers need not be used.

Further, the mesh member 21 disposed in the base layer 2B, may be used as a heater 3 using a heat source. As a result, the structure of the fixing device 10 can be simplified compared to a case using an electromagnetic induction heating apparatus.

In addition, the diameter of the opening 211 of the mesh member 21 is 36.5 μm which is less than 45 μm, so that the mesh member 21 can transmit heat such that an outer surface of the fixing belt shows a substantially same temperature. As a result, fluctuation in the fixation is suppressed and a high quality image can be obtained. Further, when the heat-resistant resin 22 fills in the opening 211, the base layer 2B can be flatly formed.

Furthermore, because the fibriform members 212 are woven to form the mesh member 21, when the mesh member 21 is bent, the fibriform member 212A and the fibriform member 212B crossing each other can be shifted, which may further improve the flexibility. And further, when tension is applied to the base layer 2B toward an inside core, the mesh member 21 extends and deforms, so that the durability of the fixing belt 2 can further be improved.

Because the fibriform member 212 is formed of at least a metal selected from a group of metals including stainless steel, aluminum, copper, cobalt, gold, and silver, heat conductivity of the mesh member 21 can be improved and the base layer 2B can be easily heated up. Among the metals, stainless steel or aluminum is particularly preferable for their lower manufacturing cost.

Further, because the heat-resistant resin 22 is formed of at least one of a group including polyimide, polyamideimide, polyphenilen sulfide, polyetheretherketone, polyether sulphone, polysulfone, and liquid crystal polymer, the base layer 2B includes a sufficient mechanical strength and heat resistance even though the fixing belt 2 is heated up to the fixing temperature. Among the heat-resistant resins, polyimide is particularly preferable from the view of high mechanical strength and heat resistance, and an optimal dimensional stability. If the heat-resistant resin includes an optimal heat resistance, the fixing belt won't extend easily, so that a slip may be prevented during fixing process.

In addition, the elastic layer 2C is formed of a silicone rubber and its thickness is 250 μm, which is more than 200 μm, so that, even though the surface of the fixing belt 2 exhibits concavity and convexity, the pressure is applied to the recording sheet S so as to absorb this concavity and convexity, to thus prevent fluctuation in the fixation and produce a high quality image.

Second Embodiment

A fixing device according to a second embodiment includes a fixing belt 8 and is disposed in the image forming apparatus 100 similarly configured as in the first embodiment.

Figure 7:
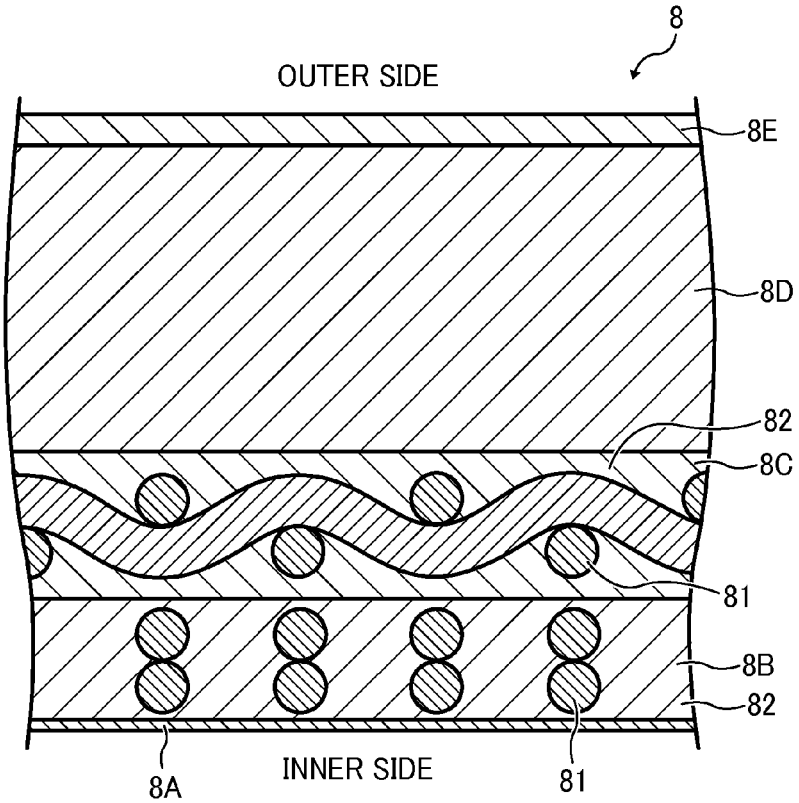
FIG. 7 is a cross-sectional view illustrating a fixing belt according to a second embodiment of the present invention.

As illustrated in FIG. 7, the fixing belt 8 includes, from an inner side to an outer side, a friction layer 8A, a first base layer 8B, a second base layer 8C, an elastic layer 8D, and a release layer 8E, in this order. The base layers 8B, 8C each include a mesh member 81 and a heat-resistant resin 82, similarly to the base layer 2B according to the first embodiment. The friction layer 8A, the elastic layer 8D, and the release layer 8E are respectively configured similarly to the friction layer 2A, the elastic layer 2C, and the release layer 2D according to the first embodiment.

Figure 8:
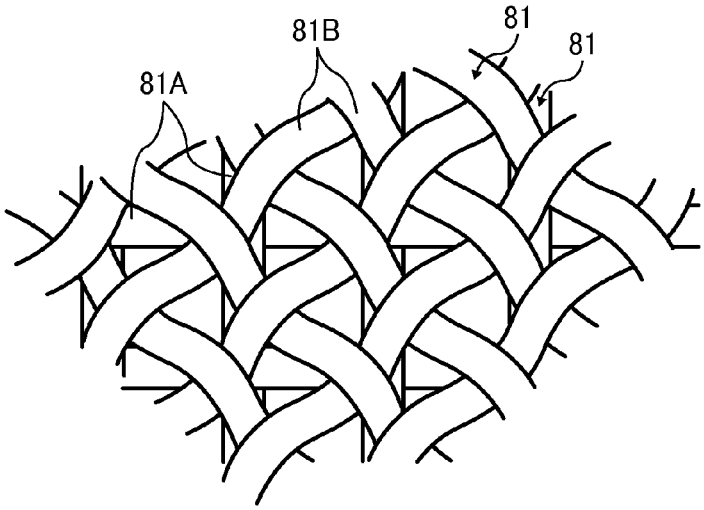
FIG. 8 is an oblique view illustrating a mesh member disposed in a base layer of the fixing belt.

Each of a fibriform member 81A of the first base layer 8B and a fibriform member 81B of the second base layer 8C extends in a direction in which the two members overlap. Specifically, the fibriform member 81A disposed in the back in FIG. 8 extends vertically and laterally, and the fibriform member 81B disposed in the frontal side extends in a direction inclined by substantially 45 degrees from the vertical direction. The degree of inclination may be arbitrarily set.

With this configuration, the same effect as that of the first embodiment can be obtained. Further, because two base layers 8B, 8C are formed instead of the single base layer 2B of the first embodiment, flexibility of the fixing belt 8 can be improved, thereby improving the durability. Furthermore, the fibriform member 81A and the fibriform member 81B overlap, which may improve flexibility against bending to different directions.

The present invention is not limited to the aforementioned embodiments, includes other configurations that can achieve purposes of the present invention, and a modified example as exemplified below may be included in the present invention.

For example, in the first embodiment, although the outer diameter of the fibriform members 212 is set to 41.7% in the thickness of the base layer 2B, alternatively this ratio need only be set to 40% or more. With this configuration, similarly to the first embodiment, the fixing belt can easily be heated up. On the other hand, if this ratio is lower than 40%, the fixing belt is hard to heat. More preferably, the outer diameter of the fibriform members 212 is 42% or more in the thickness of the base layer 2B.

In addition, in the first embodiment, the fibriform members 212 are woven, to thereby form the mesh member 21. However, the mesh member 21 need only include an opening and be formed in the net-like shape. For example, the mesh member may be formed from a sheet-shaped member with a plurality of openings, so that the shape of the opening is optional. With such a structure, for example, the sheet member is subjected to hole making, to thereby produce a mesh member without difficulty.

When a sheet-like mesh member is produced, a thickness of the thinnest portion of the mesh member is preferably 40% or more in the whole thickness of the base layer 2B.

In addition, when the opening has a triangular shape, the diameter means a longest distance between the top and one opposite side. In addition, when the opening has a polygonal shape with n-number of corners (n≥5), the diameter means a longest distance among the diagonal lines.

In the first embodiment, the mesh member 21 including an opening 211 having a diameter of 36.5 μm is used, and if the diameter is 45 μm or less, the fixed image may have a high quality and the base layer 2B can be flatly formed similarly to the first embodiment. In addition, the diameter of the opening 211 of the mesh member 21 is preferably 42 μm or less.

Further, the diameter of the opening 211 of the mesh member 21 is preferably 20 μm or more. The diameter of the opening 211 of not less than 20 μm is recommended to produce the mesh member 21 without difficulty. In addition, the diameter of the opening 211 of the mesh member 21 is preferably 25 μm or more. If the diameter of the opening 211 is less than 20 μm, more tension is required when the fibriform members 212 are woven.

Further, the diameter of the opening 211 may be more than 45 μm. In this case, although the image quality fixed to the recording sheet S degrades a little, but the tension necessary to weave the fibriform members 212 can be reduced by reducing a density of the mesh member, to thereby produce the mesh member without difficulty.

In addition, in the first embodiment, the elastic layer 2C is formed of the silicone rubber. In the present embodiment, the elastic layer 2C need only be formed of a material having a sufficient elasticity. In the first embodiment, the thickness of the elastic layer 2C is preferably 250 μm. If the thickness is 200 μm or more, the fluctuation in the fixation can be suppressed and a high quality image can be formed similarly to the first embodiment. More preferably, the thickness of the elastic layer 2C is 240 μm or more.

The thickness of the elastic layer 2C is preferably 300 μm or less. If the thickness of the elastic layer 2C exceeds the above range, heat from the base layer 2B cannot be transmitted to the recording sheet S easily. More preferably, the thickness of the elastic layer 2C is 280 μm or less. If the thickness of the elastic layer 2C is out of the preferable range, heat from the base layer 2B cannot be transmitted to the recording sheet S easily.

Further, the thickness of the elastic layer 2C may be less than 200 μm. In this case, although the image quality fixed to the recording sheet S degrades a little, but the heat from the base layer 2B can be transmitted to the recording sheet S easily, thereby reducing the power consumption of the heater 3.

Best modes and methods to implement the present invention have been heretofore described; however, the present invention is not limited thereto. Specifically, the present invention as illustrated and described with particular embodiments can be modified variously by an engineer in the related field with regard to the above-described embodiments, without distorting from the technical thought and the range of intended purposes of the present invention.

Accordingly, the description of the disclosed shapes and materials is an example to help understand the present invention and does not limit the scope of the present invention. Part or all of limitations of the disclosed shapes and materials and without limitations of the same are included in the present invention.

The present invention will be more clearly explained based on the preferred embodiments.

Fixing belts according to Examples 1 to 6 and Comparative Examples 1 to 3 were produced, each of which was built with the structure of the base layer, outer diameter of the fibriform member, diameter of the opening, thickness of the base layer, and thickness of the elastic layer as set forth in Table 1 below.

TABLE 1

| | Structure of base layer | Outer diameter of fabriform member (μm) | Diameter of opening (μm) | Thickness of base layer (μm) | Thickness of elastic layer (μm) |
|---|---|---|---|---|---|
| Example 1 | Mesh member + heat-resistant resin | 25 | 36.5 | 60 | 250 |
| Example 2 | Mesh member + heat-resistant resin | 25 | 24.5 | 60 | 200 |
| Example 3 | Mesh member + heat-resistant resin | 25 | 36.5 | 55 | 200 |
| Example 4 | Mesh member + heat-resistant resin | 20 | 28.3 | 50 | 200 |
| Example 5 | Mesh member + heat-resistant resin | 25 | 54.4 | 60 | 200 |
| Example 6 | Mesh member + heat-resistant resin | 25 | 24.5 | 60 | 150 |
| Comparative Example 1 | Mesh member + heat-resistant resin | 25 | 36.5 | 65 | 200 |
| Comparative Example 2 | PI/Ni | — | — | 60 | 150 |
| Comparative Example 3 | Ni/Cu/Ni | — | — | 40 | 150 |

The fixing belts according to Examples 1 to 6 and Comparative Example 1 were produced as follows: First, a mold is inserted to an inner side of the cylindrical mesh member formed of stainless steel fibriform member. Next, while rotating the mold, polyimide varnish (produced by Ube Industries, Ltd.) is spray-coated from an external side thereof, the mold is allowed to continue to rotate even after the coating, so that the polyimide varnish fills in the opening of the mesh member so as to cover the mesh member as a whole.

Next, the base layer is sintered at 350° C. to be turned into imide, and a base layer with an inner diameter of 30 mm and a length of 360 mm is formed. The mold is removed from the base layer, and silicone rubber (produced by Dow Corning Toray) is spray-coated on the external surface of the base layer, to thereby form an elastic layer. Further, the external surface of the elastic layer is coated with primer (produced by Dow Corning Toray), and is coated with PFA tube (produced by Kurabo Industries Ltd.), and is dried for 30 minutes at 200° C., so that a release layer is formed.

Further, PTFE film with dispersed carbon black is spray-coated on an inner surface of the base layer, and a friction layer with a thickness of 15 μm is formed.

On the other hand, the fixing belt according to Comparative Example 2 is formed such that a cylindrical member is formed of polyimide (PI) to have a thickness of 50 μm, a nickel (Ni) layer is formed on an external surface of the cylindrical member via non-electrolytic plating to have a layer thickness of 10 μm, and a base layer with the same inner diameter and length of Examples 1 to 6 and Comparative Example 1 is formed. Next, using the same method as performed in Examples 1 to 6 and Comparative Example 1, the elastic layer, the release layer, and the friction layer are formed.

A fixing belt according to Comparative Example 3 is formed such that a cylindrical member is formed of nickel to have a thickness of 29 μm, a copper (Cu) layer is formed on an external surface of the cylindrical member via non-electrolytic plating to have a layer thickness of 10 μm, and further, a nickel layer serving as an antioxidant layer is formed on an external surface of the copper layer to have a layer thickness of 1 μm. Thus, the base layer with the same inner diameter and length of Examples 1 to 6 and Comparative Example 1 was formed. Next, using the same method as performed in Examples 1 to 6 and Comparative Example 1, the elastic layer, the release layer, and the friction layer were formed.

Evaluation of Durability

The fixing belts according to Examples 1 to 6 and Comparative Examples 1 to 3 were evaluated for durability by printing 400,000 copies using the fixing unit of the copier RICOH MPC4503, produced by Ricoh Co., Ltd. Table 2 shows evaluation results.

TABLE 2

| | Structure of base layer | Durability |
|---|---|---|
| Example 1 | Mesh member + heat-resistant resin | Excellent |
| Example 2 | Mesh member + heat-resistant resin | Excellent |
| Example 3 | Mesh member + heat-resistant resin | Excellent |
| Example 4 | Mesh member + heat-resistant resin | Excellent |
| Example 5 | Mesh member + heat-resistant resin | Excellent |
| Example 6 | Mesh member + heat-resistant resin | Excellent |

TABLE 2-continued

| | Structure of base layer | Durability |
|---|---|---|
| Comparative Example 1 | Mesh member + heat-resistant resin | Excellent |
| Comparative Example 2 | PI/Ni | Not good |
| Comparative Example 3 | Ni/Cu/Ni | Excellent |

The fixing belts according to Examples 1 to 6 including the mesh member, Comparative Example 1, and Comparative Example 3 including the base layer formed of the metal alone, showed no abnormality even after printing 400,000 sheets of the recording sheets, and all showed optimal durability. By contrast, the fixing belt according to Comparative Example 2 in which a nickel layer formed on the external surface of the polyimide showed cracks thereon after 10,000 sheets were printed. Accordingly, other evaluations related to the fixing belt according to Comparative Example 2 were not performed Evaluation of Heat-Up Time The fixing belts according to Examples 1 to 6 and Comparative Examples 1 to 3 were evaluated using the above-specified fixing unit as to the surface temperature and the heat-up time of the fixing belt when the fixing belt is heated by a halogen heater serving as the heater. More specifically, a temperature of the surface of the release layer at a portion opposite the nip portion is measured by a radiation thermometer. In addition, an elapsed time period from when the thermometer showed 23 degrees C. to when it showed 120° C. was also measured. Table 3 shows measurement results.

TABLE 3

| | Outer diameter of fabriform member (μm) | Thickness of base layer (μm) | Occupancy of mesh member (%) | Heat-up time (sec) |
|---|---|---|---|---|
| Example 1 | 25 | 60 | 41.7 | 2.5 |
| Example 2 | 25 | 60 | 41.7 | 2.5 |
| Example 3 | 25 | 55 | 45.5 | 2.3 |
| Example 4 | 20 | 50 | 40.0 | 2.6 |
| Example 5 | 25 | 60 | 41.7 | 2.5 |
| Example 6 | 25 | 60 | 41.7 | 2.2 |
| Comparative Example 1 | 25 | 65 | 38.5 | 3.3 |
| Comparative Example 2 | — | 60 | — | — |
| Comparative Example 3 | — | 40 | — | 2.8 |

The fixing belts according to Examples 1 to 6 having the mesh member occupancy of 40% or more exhibits heat-up time of 2.6 seconds, which is sufficiently short. By contrast, the fixing belt according to Comparative Example 1, with the mesh member occupancy of 38.5%, exhibits heat-up time of 3.3 seconds, which is relatively long. In addition, the fixing belt according to Comparative Example 3, with the base layer formed of a metal member alone, exhibits heat-up time of 2.8 seconds, which is relatively long.

Evaluation of Image Quality

The fixing belts according to Examples 1 to 6 and Comparative Examples 1 to 3 were evaluated by depositing unfixed toner across the recording sheet using the above-specified fixing unit, as to the image quality when the unfixed toner is fixed onto the recording sheet. Table 4 shows the evaluation results.

TABLE 4

| | Diameter of opening (μm) | Thickness of elastic layer (μm) | Image quality |
|---|---|---|---|
| Example 1 | 36.5 | 250 | Excellent |
| Example 2 | 24.5 | 200 | Excellent |
| Example 3 | 36.5 | 200 | Excellent |
| Example 4 | 28.3 | 200 | Excellent |
| Example 5 | 54.4 | 200 | Uneven glossiness |
| Example 6 | 24.5 | 150 | Orange peel-like unevenness |
| Comparative Example 1 | 36.5 | 200 | Excellent |
| Comparative Example 2 | — | 150 | — |
| Comparative Example 3 | — | 150 | Excellent |

The fixing belts according to Examples 1 to 4 and the fixing belt according to Comparative Example 1, including the mesh member having the opening with a diameter of 45 μm or less and the elastic layer with a thickness of 200 μm or more, and the fixing belt according to Comparative Example 3 including the fixing belt including the base layer formed of the metal alone, showed optimal image quality. On the other hand, the fixing belt according to Example 5, including an opening with a diameter of 54.4 μm, showed uneven glossiness in the fixed image. In addition, the fixing belt according to Example 6, including the elastic layer with a thickness 150 μm, showed orange peel-like unevenness in the fixed image.

Additional modifications and variations of the present invention are possible in light of the above teachings. It is therefore to be understood that, within the scope of the appended claims, the invention may be practiced other than as specifically described herein.

What is claimed is:

1. A fixing belt for a fixing device of an image forming apparatus, comprising:

a base layer including a heat-resistant resin; and a mesh member embedded in the heat-resistant resin and including a metal member, wherein the mesh member includes an opening, the heat-resistant resin fills in the opening, and a thickness of a thinnest portion of the mesh member is 40% or more of a thickness of the base layer.

2. The fixing belt as claimed in claim 1, wherein a diameter of the opening is 45 μm or less.

3. The fixing belt as claimed in claim 1, wherein the mesh member is formed of a woven fibriform member, and an outer diameter of the fibriform member equals the thickness of the thinnest portion of the mesh member.

4. The fixing belt as claimed in claim 3, wherein the metal member is formed of at least one selected from the group consisting of stainless steel, aluminum, copper, cobalt, gold, and silver.

5. The fixing belt as claimed in claim 1, wherein the heat-resistant resin is formed of at least one selected from the group consisting of polyimide, polyamideimide, polyphenilen sulfide, polyetheretherketone, polyether sulphone, polysulfone, and liquid crystal polymer.

6. The fixing belt as claimed in claim 1, further comprising an elastic layer formed of silicone rubber, wherein a diameter of the elastic layer is 200 μm or more.

7. A fixing device comprising:

the fixing belt of claim 1;

a heater to heat the fixing belt; and a pressure rotator disposed opposing the fixing belt.

8. An image forming apparatus comprising:

an image forming section to form an image on a recording medium; and the fixing device of claim 7 to fix the image on the recording medium.

* * * * *